United States Patent [19]

Ruden

[11] Patent Number: 4,830,366

[45] Date of Patent: May 16, 1989

[54] EXERCISE DEVICE UTILIZING A COMPRESSION MEMBER AND ELASTIC TENSION MEMBERS TO ALTERNATELY EXERCISE DIFFERENT SETS OF MUSCLES

[76] Inventor: Ronald A. Ruden, 118 E. 91st St., New York, N.Y. 10128

[21] Appl. No.: 148,295

[22] Filed: Jan. 25, 1988

[51] Int. Cl.[4] ..... A63B 21/00; A63B 21/02

[52] U.S. Cl. ..... 272/137; 272/116; 272/139

[58] Field of Search ..... 272/67, 68, 116, 135, 272/137, 139–142, 130, 96, 125, 143, 124, 128; 84/376

[56] References Cited

U.S. PATENT DOCUMENTS

| | | | |
|---|---|---|---|
| 2,022,002 | 11/1935 | Jacks | 272/57 |
| 3,069,162 | 12/1962 | Samuel | 272/135 X |
| 3,659,846 | 5/1972 | Kanicki | 272/80 |
| 3,756,592 | 9/1973 | Johnson | 272/128 |
| 3,759,514 | 9/1973 | Cox | 272/142 X |
| 3,971,255 | 7/1976 | Varney et al. | 73/379 |
| 4,022,463 | 5/1977 | Scott, Jr. | 272/136 |
| 4,105,200 | 8/1978 | Unger | 272/67 |
| 4,248,421 | 2/1981 | Salazar | 272/130 |
| 4,376,533 | 3/1983 | Kolbel | 272/137 |
| 4,530,496 | 7/1985 | Smith et al. | 272/68 |
| 4,711,445 | 12/1987 | Whitehead | 272/67 |

*Primary Examiner*—Richard J. Apley
*Assistant Examiner*—Franklin L. Gubernick
*Attorney, Agent, or Firm*—McAulay, Fields, Fisher, Goldstein & Nissen

[57] ABSTRACT

The present invention provides an exercise device including a compression member having a pair of opposed bearing surfaces. A pair of elastic, elongated tension members are connected to opposed surfaces of the compression member, and a pair of strap members are connected to one another by the pair of tension members. The strap members loop over the bearing surfaces so that a pair of opposed limbs of the user can be inserted within the strap members and against the bearing surfaces. When the user's limbs exert inwardly directed compressive forces against the bearing surfaces, the compression member produces outwardly directed resistive forces in reaction to the inwardly directed forces exerted by the limbs. When the user's limbs exert outwardly directed forces on the strap members, the tension members stretch and in turn produce inwardly directed resistive forces in reaction to the outwardly directed forces exerted by the limbs. In a given exercise routine, the user can exercise different sets of muscles of the limbs by alternately exerting compressive and tensile forces on the bearing surfaces and the strap members, respectively.

6 Claims, 1 Drawing Sheet

EXERCISE DEVICE UTILIZING A COMPRESSION MEMBER AND ELASTIC TENSION MEMBERS TO ALTERNATELY EXERCISE DIFFERENT SETS OF MUSCLES

FIELD OF THE INVENTION

This invention relates to exercise devices and more particularly to an exercise device in which a user can exercise different sets of muscles by alternately applying tensile forces and compressive forces to the device.

BACKGROUND OF THE INVENTION

Many exercise devices have been developed in the prior art that enable a user to exercise by applying a force in reaction to a resistive force produced by the device. In one type of device, the resistive force acts only in one direction. The disadvantage of this is that the user can only exert a force in one direction against the resistive force and hence, only a single set of muscles can be exercised at any one time. Such devices are however, relatively simple. In this regard, U.S. Pat. No. 2,022,002 discloses an exercise device that essentially consists of a spring to provide the resistance. The user places the device between, for instance, his or her knees and inwardly moves the knees, towards one another, to compress the spring. As is apparent, the muscles that would be used to move the knees in the opposite direction are not capable of being exercised by this device. U.S. Pat. No. 3,659,846 provides a spring, that, at one end, is attached to an immovable object and that, at the other end, is connected to a strap worn on the knee. During an exercise routine using this device, only the muscles used for moving the knee away from the immovable object are capable of being exercised. Similarly, U.S. Pat. No. 4,022,463 discloses an exercise device that has a pair of centrally pivoted arms in which each of the arms are connected, at one end, to a spring. The user exercises by pushing the other, unconnected ends of the arms together. Again, the muscles of the user that would operate to pull the arms of the device away from one another are not capable of being exercised by the device. A more complex device is disclosed in U.S. Pat. No. 4,376,533 in which the user can push against a pair of elongated, telescopic members containing a spring or pull the ends of a rope that are attached by pulleys to the ends of the members. As is apparent from the device, the user cannot alternately push and pull the device in that the ends of the device have to be grasped in order for the user to push against the device or alternately, the rope has to be grasped in order for the user to exert a pull against the device.

As can be appreciated from the above discussion, an exercise device that is operable to offer a resistance to either a compressive or a tensile force, is, by necessity, more complex and hence, more expensive than a device that simply supplies a resistance to either a compressive or a tensile force. For instance, U.S. Pat. No. 4,376,533 discussed above, provides spring loaded telescopic members and ropes attached by pulleys to the members to provide resistances to both tensile and compressive forces. This device is to be compared with U.S. Pat. No. 2,022,002 which simply supplies a resistance to a compressive force and which essentially consists of a spring.

A device that is capable of alternately offering resistances to alternatively applied tensile and compressive forces can be even more complex than the devices discussed above. Such a device is disclosed in U.S. Pat. No. 3,971,255. The device disclosed by this patent has a shaft that axially extends through a housing. A pair of springs, located in this housing, are alternately compressed, as the user pushes and pulls the shaft through the housing. In order for the user to exert a force by his or her knees against the device, the user must be in a sitting position and a set of yokes must be fitted to the device at the shaft and at the housing. In order for the user to exert a force by his or her hands, a set of handles must be fitted to the device.

The exercise device of the present invention can offer alternate resistance to compressive and tensile forces applied to the device, to thereby alternately exercise different sets of muscles at the same time that the device is being used. The device includes, in a preferred embodiment, a deformable, resilient compression member that has a pair of opposed, spaced bearing surfaces and a pair of strap members that loop over the bearing surfaces. The strap members are connected to one another by a pair of elastic, elongated tension members. The user inserts a pair of his or her limbs into the strap members and against the bearing surfaces and thereafter, exercises by alternately exerting compressive forces on the bearing surfaces and tensile forces on the tension members through the strap members.

The compression member can essentially consist of a block of foam rubber and the tension members can essentially consist of elastomeric strips. As a result, the exercise device of the present invention can be simply and inexpensively assembled from inexpensive materials. Moreover, the simplicity of an exercise device of the present invention provides advantages that are not found in the prior art exercise devices, discussed above. For instance, the user can exert compressive and tensile forces by any combination of limbs of his or her body, thus doing away with the need for any special attachments for the device. Since strap members allow the device to be worn on the body, the user can exercise in any conceivable position. Additionally, the user can exercise at any desired pace. For instance, if a user were exercising with the device of U.S. Pat. 2,022,002, between his or her legs and the user briefly relaxed between exertions, the device would simply drop from the knees. In the exercise device of the present invention, if the user relaxes, the strap holds the device in position and on the limbs of the user.

SUMMARY OF THE INVENTION

The present invention includes a deformable, resilient compression member, a pair of oppositely disposed, elongated strap members and means for elastically connecting the strap members to one another. The compression member has a pair of opposed, spaced bearing surfaces which, due to the construction of said member, are resiliently connected to one another to produce a pair of outwardly directed resistive forces in reaction to a pair of inwardly directed compressive forces that are applied to the bearing surfaces. The strap members are sized and located to loop over the bearing surfaces so that a pair of opposed limbs of a user can be inserted within said strap members and against the bearing surfaces. The elastic connection means, which is attached to the compression member, also has means for producing a pair of inwardly directed resistive forces in reaction to a pair of outwardly directed forces exerted by the user's limbs on the strap members. As a result, the user can exercise different sets of muscles by alternately exerting, by his or her limbs, a pair of outwardly directed forces on the strap members and a pair of inwardly directed forces on the bearing surfaces.

Additional features and advantages of the present invention will become more apparent from a consideration of the following detailed description when taken in conjunction with the accompanying drawings.

DETAILED DESCRIPTION OF THE INVENTION

Figure 1:
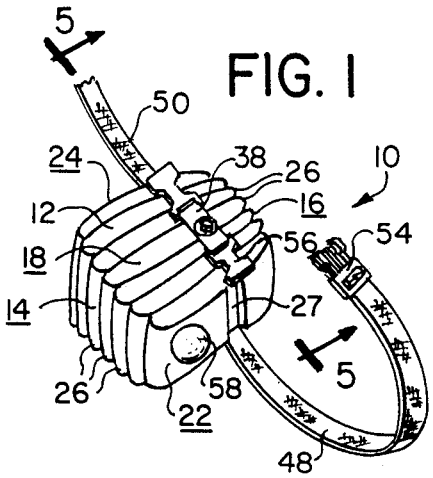
FIG. 1 is a perspective view of an exercise device of the present invention.

With reference to the Figures, the preferred embodiment of the exercise device of the present invention is represented generally by numeral 10. Device 10 includes a deformable, resilient compression member 12 preferably made of open cell polyurethane foam, and molded in a block-like shape having front and rear surfaces 14, 16, top and bottom surfaces 18, 20 and opposed end surfaces 22, 24. Alternatively, compression member 12 may be formed of other sponge-like material, such as foam rubber. The front, rear, top and bottom surfaces 14, 16, 18 and 20 represent a set of interconnected lateral surfaces connecting the end surfaces 22, 24 on opposite sides of compression member 12. The end surfaces 22, 24 represent bearing surfaces which are in contact with selected portions of the user's body when the device 10 is in use, as hereinafter described.

Compression member 12 is formed having a plurality of accordion-like segments 26 that extend peripherally around the lateral surfaces of device 10, notably around the front, top, rear and bottom surfaces 14, 18, 16 and 20, respectively. The purpose of the segments 26 is two-fold. The accordion-like segments enhance the stability of the device in keeping the spaced end surfaces 22, 24 properly orientated during compression of said end surfaces in the direction toward one another. Moreover, the segments also lessen the effect of cyclical stresses induced in the lateral surfaces by the alternate compressive loading on the end surfaces.

Compression member 12 is formed having a continuous recess or groove 27 which extends peripherally around the top, bottom and end surfaces 18, 20, 22 and 24. Recess 27 receives and accomodates other portions of the device as hereinafter noted.

Figure 5:
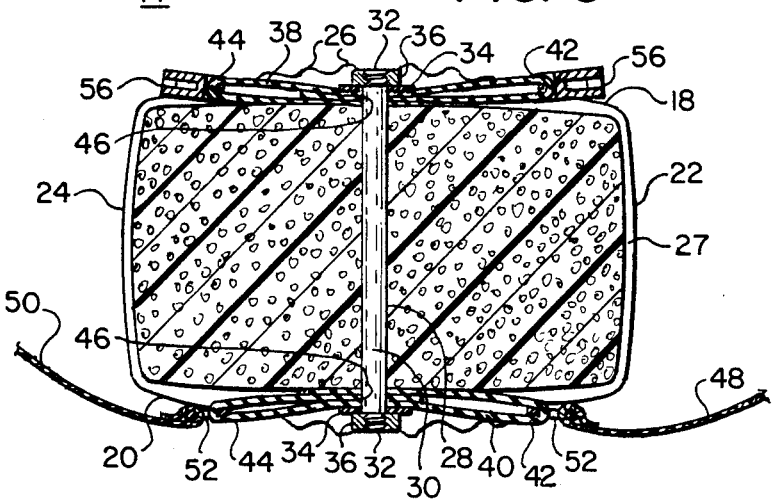
FIG. 5 is a cross-sectional view of an exercise device of the present invention taken along line 5—5 of FIG. 1.

Compression member 12 also is formed having a vertically oriented bore or through-opening 28 for receiving a bolt 30. With reference to FIG. 5, the opposite ends of bolt 30 are threaded, as represented by numeral 32, and extend beyond the top and bottom surfaces 18, 20 of compression member 12, respectively. The threaded bolt ends 32 receive washers 34 and nuts 36 for securing tension members 38, 40 to the compression member 12 as hereinafter described. Through-opening 28 is located to pass through the region of top and bottom surfaces 18, 20 defined by recess 27.

Tension members 38, 40 each comprise, preferably, an elastomeric strip of material which is folded over to form loop ends 42, 44. A central opening 46 is formed in each folded strip. The elastomeric tension members are sized to fit within recess 27 and are located with their central openings 46 aligned with the through-opening 28 of compression member 12. Accordingly, it is now apparent that tension members 38, 40 are attached to compression member 12 by means of the bolt 30 which passes through the aligned openings 28 and 46, and secured in place by nuts 36.

Figure 3:
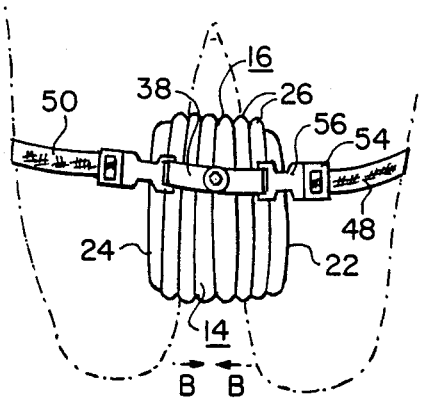
FIG. 3 is a view similar to that of FIG. 2 in which compressive forces are exerted by the inner knee portions the user's legs.
Figure 2:
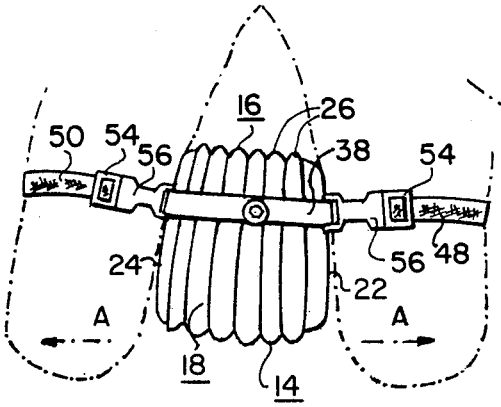
FIG. 2 is a top plan view of an exercise device of the present invention in which tensile forces are exerted on the device by the knee portions of the user's legs.

Device 10 further includes strap members 48, 50 connected to the tension members 38, 40 for securing the device around the thighs of the user as shown in FIGS. 2 and 3. Straps 48, 50 are inelastic, preferably formed of nylon mesh. One end of straps 48, 50 is connected to the ends of bottom tension member 40 by means of connecting rings 52, in conventional manner. The other or opposite end of straps 48, 50 is removably fastened to the ends of the top tension member 38 by bayonette-type clasp members 54, 56. That is, one part 54 of the engageable clasp members is connected to the end of strap 48 whereas the other part 56 of the clasp is formed as a closed bracket through which is looped the tension member. The same connecting arrangement applies in connecting strap 50 to tension members 38, 40. The mating parts of the clasp members are releasably engageable in conventional manner. As will be appreciated, the connecting rings 52 and the clasp parts 56 are connected to tension members 38, 40 prior to mounting said tension members in place within the recess 27 of compression member 12. The releasable mounting arrangement is such as to permit the exercise device to be easily removed from the limbs of the user.

As is now apparent, tension members 38, 40 serve to elastically connect strap members 48, 50 to one another, and are operable to provide an inwardly directed force at the ends thereof when an outwardly directed force is applied to the ends through said strap members. Additionally, the elasticity of the tension members 38, 40 is such as to permit flexure of the muscles being exercised.

Figure 4:
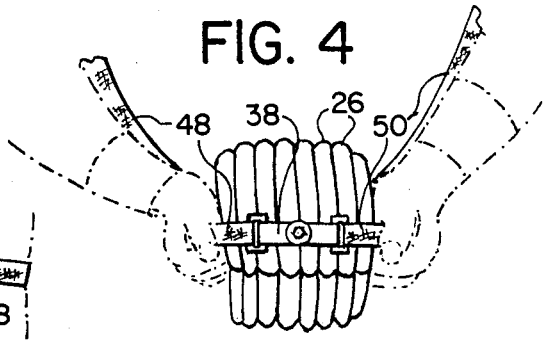
FIG. 4 is a perspective view of an exercise device of the present invention in which the tensile and compressive forces are alternately being exerted by the user's arms.

FIGS. 2 and 3 of the drawings show device 10 positioned in use for exercising various muscles in the region of the thigh while FIG. 4 shows the device in use for exercising muscles in the arms. With reference to FIGS. 2 and 3, the device is positioned between the inner knee portions of the user's legs. Straps 48, 50, which previously had been connected to the loop ends 42, 44 of tension member 40, are then wrapped around the thighs and secured to the loop ends 42, 44 of tension member 38 by means of clasp members 54, 56.

In order to improve comfort when device 10 is in use, recess 27 is located rearwardly of the central axis of the device, as viewed in FIGS. 2 and 3, to locate straps 48, 50 rearwardly up the thighs and away from the knee portions of the user. This, in turn, maximizes the contact areas of the device, in the region forward of the recess, against which bear the user's knees during compression of member 12. For additional comfort, end surfaces 22, 24 may be formed with a concave or dished surface 58 to receive the knee portions during the compression cycle.

The user exercises by alternately exerting a pair of outwardly directed tensile forces, indicated by arrow A of FIG. 2, on the strap members 48, 50 to stretch the tension members 38, 40, and a pair of compressive forces, as indicated by arrow B of FIG. 3, on the bearing surfaces 22, 24 of the compression member 12. That is, compression member 12 produces a pair of outwardly directed resistive forces when a pair of inwardly directed compressive forces are applied to end surfaces 22, 24, as illustrated by arrow B in FIG. 3. Moreover, the resilience of member 12 is such as to resiliently connect end surfaces 22, 24 to one another to thereby permit flexure of the muscles being exercised. Thus, the exercise device 10 of the present invention can alternately provide resistance to both tensile and compressive forces to exercise different sets of muscles of the thighs without having to re-position the device. Specifically, the abductor muscles are exercised when the limbs are moved apart against the resistive force of the tension members 38, 40, and the adductor muscles are exercised when the limbs are moved toward one another against the resistive force of the compression member 12.

Additionally, the device does not require special attachments or separate elements for exerting such forces by the user's hands. For instance, in FIG. 4, the user inserts his or her hands into the strap members 48, 50 and then pulls outwardly to exert tensile forces against the resistance provided by tension members 38, 40 and pushes inwardly against the bearing surfaces 22, 24 to exert compressive forces against the resistance offered by the compression member 12.

If necessary, smaller length straps can be used when exercising the arm muscles as compared to exercising the thigh muscles. Alternatively, means can be incorporated for adjusting the length of the straps, as needed.

It is contemplated that when using the device to exercise the arm muscles, the orientation of the device will be rotated 180 degrees to locate recess 27 forwardly of the central axis of the device away from the user's body, to maximize the contact area of the bearing surfaces in the region of the user's palms.

The overall design of the device permits the tension members 38, 40 to seat across the accordion-like segments 26, within the recess or groove 27. The capture of tension members 38, 40 within recess 27 also serves to keep the tension members in a generally horizontally aligned position, as viewed in the drawings, so that the forces are exerted axially or longitudinally along said members when said members are under tension.

Although a pair of tension members is preferred, it is understood that an alternative embodiment of the invention could provide for a single tension member secured peripherally around the compression member, with the pair of straps connected to opposed portions of the tension member in the region adjacent the end surfaces of the compression member. It also is envisioned that both the tension member and the straps may be made of elastic material.

While specific embodiments in the invention have been shown and described, the invention should not be considered as so limited, but may be otherwise variously embodied and practiced within the scope of the following claims.

I claim:

1. An exercise device comprising:

a deformable, resilient compression member having a pair of opposed, spaced bearing surfaces;

a pair of oppositely disposed elongated strap members mounted on said compression member and sized and located to be spaced from said bearing surfaces so that a pair of opposed limbs of the user can be inserted between said strap members and said bearing surfaces;

said compression member producing a pair of outwardly directed forces at said bearing surfaces in reaction to a pair of inwardly directed compressive forces exerted by said limbs on said bearing surfaces; and a pair of elastic tension members mounted on said compression member and elastically connecting said strap members to one another, said elastic members producing a pair of inwardly directed forces in said strap members in reaction to a pair of outwardly directed forces exerted by said limbs on said strap members;

whereby said user can exercise different sets of muscles of said limbs by alternately exerting a pair of said outwardly directed forces on said strap members and a pair of said inwardly directed forces on said bearing surfaces.

2. The exercise device of claim 1 wherein:

said compression member has a set of interconnected lateral surfaces connecting said bearing surfaces on opposite sides of said compression member;

said strap members are inelastic;

one of said pair of tension members being positioned on one of said lateral surfaces and the other of said tension members being positioned on another of said lateral surfaces located opposite to said one lateral surface;

means for mounting said pair of tension members on the respective one and another of said lateral surfaces;

means for releasably connecting one end of one of said strap members to one end of one of said tension members, and for releasably connecting one end of the other of said strap members to another end of said one tension member; and means for connecting the other ends of said strap members to the respective ends of the other of said tension members.

3. The exercise device of claim 1 wherein each of said tension members comprises an elastomeric strip of material.

4. The exercise device of claim 2, wherein said compression member has a plurality of accordion-like segments that peripherally extends around said lateral surfaces between said bearing surfaces, and an elongated groove that peripherally extends around said bearing surfaces and said lateral surfaces, said tension members being seated within said groove.

5. The exercise device of claim 4 wherein said tension member mounting means includes:

a stud member;

said compression member having a bore communicating between said one and said another lateral surfaces within said groove;

each of said tension members having a centrally located aperture aligned with the opposite ends of said bore;

said stud member being received within said bore and having a pair of opposed threaded ends which project through said apertures of said tension members; and a pair of nuts threaded on said ends of said stud to hold said tension members in place within said groove.

6. The exercise device of claim 1, wherein each of said bearing surfaces has a recessed zone adapted to receive portions of the user's limbs when compressive forces are exerted on said bearing surfaces.

* * * * *